US005282292A

United States Patent [19]

Levy

[11] Patent Number: 5,282,292

[45] Date of Patent: * Feb. 1, 1994

[54] FLEXIBLE CLOSURE CARRIER

[76] Inventor: James F. Levy, 434 Barnwell St., Columbia, S.C. 29202

[ * ] Notice: The portion of the term of this patent subsequent to Mar. 2, 2010 has been disclaimed.

[21] Appl. No.: 909,696

[22] Filed: Jul. 7, 1992

Related U.S. Application Data

[63] Continuation-in-part of Ser. No. 735,450, Jul. 25, 1991, abandoned.

[51] Int. Cl.[5] ..... E05D 15/00

[52] U.S. Cl. ..... 16/87.2; 16/95 D

[58] Field of Search ..... 16/87.2, 87.4 R, 87.4 W, 16/89, 93 D, 94 D, 95 D, 96 D, 97; 160/330, 345; 409/409

[56] References Cited

U.S. PATENT DOCUMENTS

| | | | |
|---|---|---|---|
| 1,661,137 | 2/1928 | Furlong | 16/89 |
| 4,115,899 | 9/1978 | Ford | 16/87.4 R |
| 4,584,737 | 4/1986 | Ohman | 16/87.4 R |
| 4,675,939 | 6/1987 | Fukada | 16/87.4 R |
| 4,729,148 | 3/1988 | Levy | 16/87.2 |
| 4,846,249 | 7/1989 | Cooper et al. | 16/87.4 R |

*Primary Examiner*—David Jones
*Assistant Examiner*—Thomas C. Schoeffler
*Attorney, Agent, or Firm*—Michael A. Mann

[57] ABSTRACT

A support system for a flexible closure such as a shower curtain comprising a rod with a channel running lengthwise and a plurality of carrier assemblies freely movable within the channel. The carrier assemblies each further comprise a roller assembly and a button assembly, the roller assembly having two wheels joined together by an axle and rolling on rails formed in the rod's channel, and the button assembly having a button and a stop joined by an axle. The roller assembly and button assembly each fit into a different hole in the carrier assembly, the holes both having a large portion and an adjacent smaller portion connected by a tapered passage that forms a keylock to allow the assemblies to be securely seated in the smaller portions.

14 Claims, 2 Drawing Sheets

FLEXIBLE CLOSURE CARRIER

This is a continuation-in-part of a patent application Ser. No. 735,450, filed Jul. 25, 1991, now abandoned.

BACKGROUND OF THE INVENTION

1. Field of the Invention:

The present invention relates to carriers for supporting flexible closures such as shower curtains and draperies from rods.

2. Discussion of Background:

A flexible closure such as a shower curtain or draperies typically is supported from an overhead horizontal support bar or tube attached to the walls by suspension hooks or rings that loosely encircle the bar passing through holes in the upper margin of the curtain. With use, there is a tendency for the shower curtain to separate from suspension hooks. Furthermore, periodically the shower curtain needs to be cleaned, so the hooks or rings must be disconnected from the curtain before laundering.

There are numerous systems for supporting flexible closures. See for example, U.S. Pat. No. 4,217,676 issued to Terrones, U.S. Pat. No. 3,861,001 issued to Pape, U.S. Pat. No. 3,175,243 issued to Weber, and U.S. Pat. No. 1,227,020 issued to Thompson. More recently, I disclose a flexible closure carrier in U.S. Pat. No. 4,729,148 issued in March 1988.

The characteristics of a good flexible closure support system are that it be easily manufactured, easily assembled, easily installed, and certain in its hold on the supported closure. Additionally, the support system should allow the easy removal of the flexible closure for cleaning and should also have a decorative appearance.

A flexible closure support system having many of these characteristics is described by this applicant in my copending application for patent, Ser. No. 588,365, filed Sep. 26, 1990, now U.S. Pat. No. 5,189,758. The system disclosed therein comprises a rod with a channel running lengthwise therein and a carrier assembly that includes a button assembly to which the curtain is fastened. The carrier has a hook on each end, one for receiving and locking a roller assembly, that fits into the channel of the rod, and one for receiving and locking the button assembly. However, this support system can still result in the curtain being pulled loose if the curtain is pulled hard enough. Finally, although a shower curtain is not designed or intended to be a safety device for someone who is slipping or falling in a shower stall, people will instinctively reach out and grab for whatever is within reach. It is therefore better for a shower curtain to be more securely fastened than less.

SUMMARY OF THE INVENTION

According to its major aspects and broadly stated, the present invention is a carrier for a flexible closure such as a shower curtain or draperies. The carrier further comprises a shank with a roller assembly received and secured in one end and a button assembly received and secured in the other end. Each end of the carrier has means for receiving and securing its respective assemblies. These means are designed to facilitate installation and locking of the assemblies to the respective ends of the shank but significantly restrict removal. Two embodiments of the present invention show variations of installation and locking means and a second embodiment shows a stronger, more stable, embodiment of the end of the shank that receives the button assembly.

The roller assembly comprises two wheels separated but joined to an axle. The axle has a segment of reduced diameter. At one end of the shank is a hole with two ends, a larger diameter end and a smaller diameter end. Either wheel of the roller assembly fits into the larger diameter end of the hole but not into the smaller diameter end. Near the smaller diameter end, the size of the hole is slightly smaller than the diameter of the segment of the axle, and, in the preferred embodiment, there are two cut-out portions communicating with the smaller diameter end and angled so that they allow the momentary enlargement of the smallest part of the hole when the roller assembly passes to the smaller diameter end and obstruct the movement of the roller assembly out of that end. Thus the end of the shank has a "keylock" arrangement that enables the roller assembly to be easily installed but difficult to remove.

The button assembly comprises a button and a stop spaced apart from each other and joined by an axle in the same fashion as the wheels of the roller assembly. The axle of the button assembly also has a segment with a reduced diameter. The larger portion of the hole for the button assembly is dimensioned to receive the stop but not the button, and the smaller portion of the hole, to receive the segment but not the axle. A similar "keylock" arrangement to that of the roller assembly is used for the button assembly; that is, the hole of the shank for the button assembly has a portion just narrower than the segment near the end of the hole that resists removal of the button assembly after it is fully seated in the smaller end of the hole. In one preferred embodiment, there are two cut out portions adjacent but not communicating with the hole to allow the sides of the hole at its most narrowest portion to spread apart temporarily for the segment to pass through. In another embodiment, the shank at the button assembly end is bifurcated; that is, the end is divided into two spaced-apart members that hold different parts of the axle of the button assembly more rigidly and horizontally than a non-bifurcated shank could do. This embodiment is for heavier closures or a more secure hold.

An important feature of the present invention is the use of holes rather than hooks or other openings for receiving and securing the roller and button assemblies. The use of holes allows a continuous part of the carrier to encircle the particular subassembly—roller assembly and button assembly—for better strength and long term integrity. Although shower curtains are usually not designed or required to bear much weight, the present invention is stronger than most, yet remains light in weight.

Another important advantage of the present invention is the keylock system which makes it easy to assemble the carrier but difficult for the assemblies to work loose from the shank during use or casual handling.

In the alternative embodiments, the use of cut-out portions to make installation of the assemblies in their respective ends of the shank even easier but removal even harder is another important feature of the present invention. Also, the feature of the bifurcated shank in one embodiment adds significant strength in those applications where it might be needed.

Other features and advantages of the present invention will be apparent to those skilled in the art from a careful reading of the Detailed Description of a Preferred Embodiment presented below and accompanied by the drawings.

DETAILED DESCRIPTION OF PREFERRED EMBODIMENTS

Figure 1:
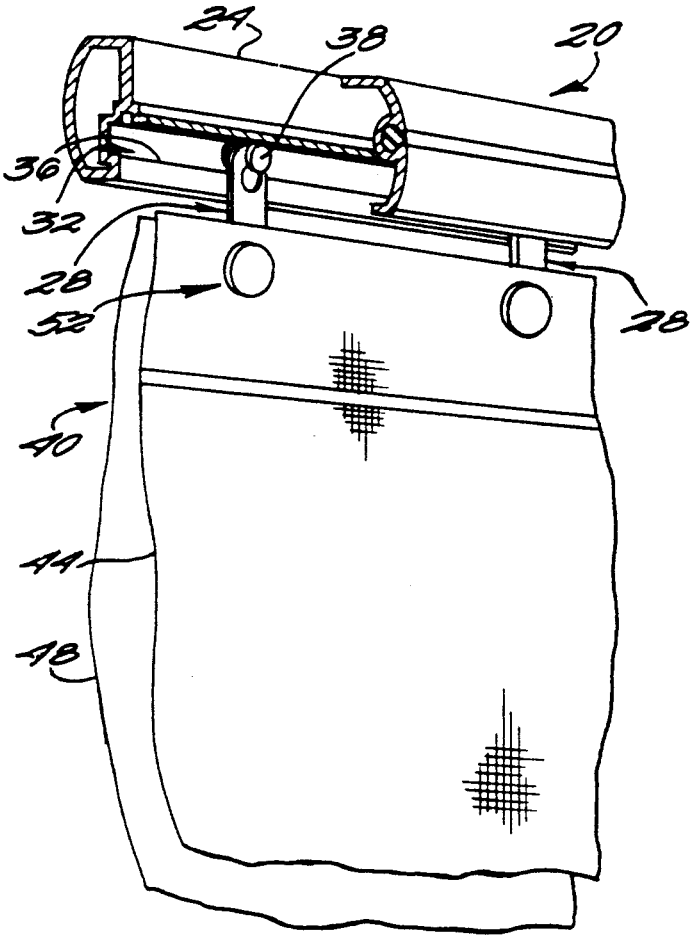
FIG. 1 is a perspective view of a flexible closure support system according to a preferred embodiment of the present invention.

Referring now to FIG. 1, there is illustrated a flexible closure support system according to a preferred embodiment of the present invention. The flexible closure system, generally indicated by the reference numeral 20 comprises a rod 24 with a plurality of carrier assemblies 28. Rod 24 has a channel 32 formed lengthwise therein, preferably as shown in FIG. 1, along the bottom of rod 24 when rod 24 is oriented for mounting to a wall (not shown). Channel 32 preferably has a pair of rails 36 formed for supporting carrier assemblies 28 in a manner that will be described presently. Running within channel 32 and riding on rails 36 is a roller assembly 38.

Hanging from carrier assemblies 28 is a flexible closure 40 which, as illustrated, comprises a decorative outer panel 44 and a water control inner panel 48 for use with shower stalls and shower baths. Closure 40 is fastened to carrier assembly 28 by a button assembly 52.

Figure 2:
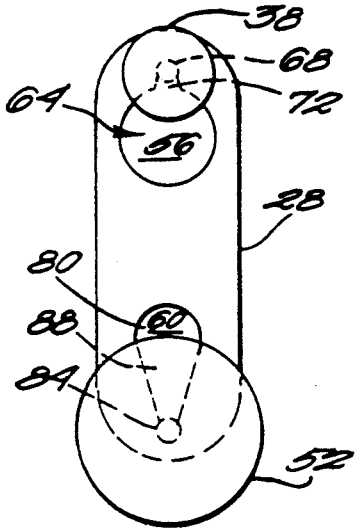
FIG. 2 is a front view of a carrier assembly according to a preferred embodiment of the present invention.
Figure 4:
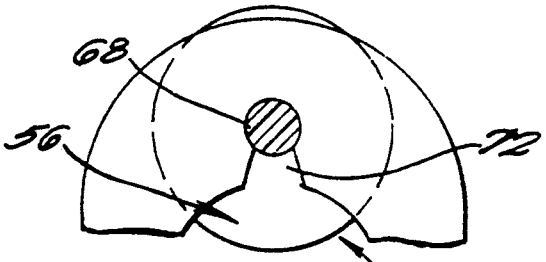
FIG. 4 is a detailed view of a shank with a keylock according to a preferred embodiment of the present invention.

FIG. 2 shows a side view of carrier assembly 28 with roller assembly 38 and a button assembly 52. Carrier assembly 28 has two holes, 56 and 60, for receiving and securing roller assembly 38 and button assembly 52, respectively. Hole 56 has a first portion 64 and a smaller, adjacent second portion 68. Between first and second portions 64, 68 is a passage 72, as best seen in FIG. 4, that is tapered toward second portion 68 so as to have a width, when it meets second portion 68, that is narrower than the diameter of second portion 68.

Hole 60 is similar to hole 56 in that it has a first portion 80 and a smaller, adjacent second portion 84 with a passage 88 therebetween. Passage 88 is tapered in the same fashion as passage 72. Both passages 72 and 88 form keylocks, wherein it is relatively easier to move an axle from a large portion to a small portion of a hole such as holes 56 or 60 than move and axle in the reverse direction.

Figure 3:
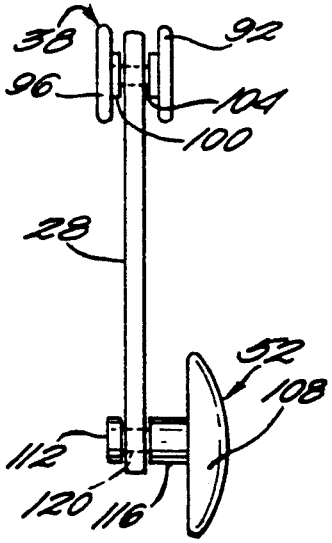
FIG. 3 is a side view of the carrier assembly shown in FIG. 2.

A side view of carrier assembly 28 with roller assembly 38 and button assembly is shown in FIG. 3. Roller assembly 38 comprises two wheels 92 and 96 with an axle 100 therebetween, separating and attached to wheels 92, 96. A segment 104 of axle 100 has a reduced diameter. Second portion 68 of hole 56 is dimensioned to receive segment 104 and too small to receive axle 100. First portion 64 is dimensioned to receive either wheel 92 or 96. Roller assembly 38 can be passed into first portion 64 and urged through passage 72 to second portion 68 when segment 104 is aligned with second portion 68.

Button assembly 52 has some similarities to roller assembly 38 but with some differences. Button assembly 52 has a button 108 and a stop 112 with an axle 116 therebetween. Axle 116 has a segment 120 with a reduced diameter. First portion 84 is dimensioned to receive stop 112, but not button 108, and second portion 88 is dimensioned to receive segment 120, so that button assembly can be passed into hole 60, stop 112-end-first, then moved to second portion 88 as long as segment 120 is aligned with second portion 88.

Because of the shape and relative dimensions of passages 72 and 88, roller assembly 38 and button assembly 52 are easily installed and locked into position. Because first portion 84 of hole 60 is smaller than first portion 64 of hole 56, roller assembly will only fit into hole 56. When secured, neither roller assembly 38 nor button assembly 52 are easily removed or will easily work loose in use. Assembling carrier assembly 28 is straightforward, with each subassembly snapping into place with an audible click. Furthermore, because these assemblies are received in holes rather than hooks or other open features, it is very difficult to pull flexible closure 40 from the present support system 20. The subassemblies do not tend to slide or slip from side to side because the segments on each are dimensioned in terms of diameter and width to just fit into the second portions of holes 56 and 60 with close tolerances. Finally, once a flexible closure such as a shower curtain is installed onto button assemblies 52, it does not need to be removed. Rather, the closure and support system can be laundered together. The carrier assemblies 28 of the laundered curtain can then simply be rolled back into channel 32.

Figure 5:
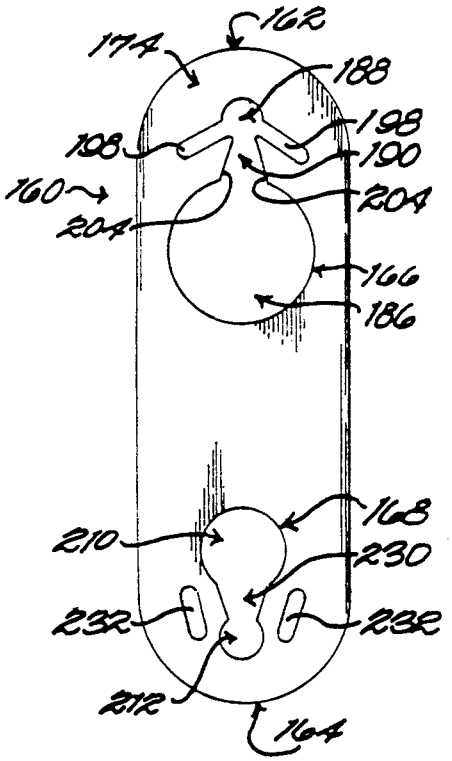
FIG. 5 is a side view of a shank with a keylock system according to an alternative view of the present invention.
Figure 6:
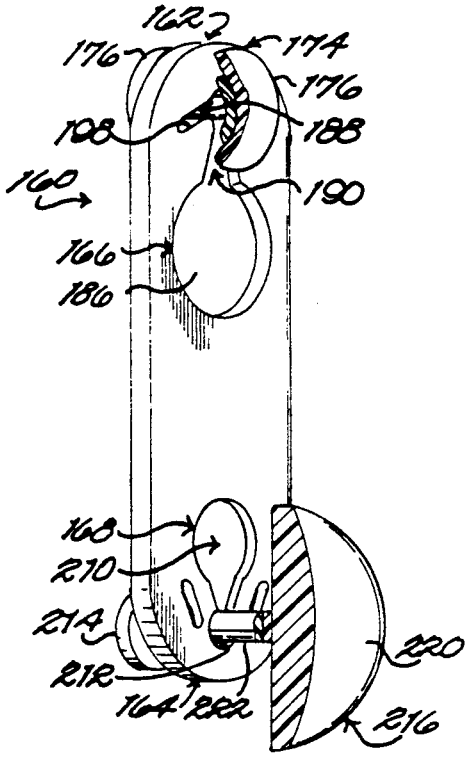
FIG. 6 is a perspective view of the shank of FIG. 5.

FIGS. 5 and 6 illustrate an alternative embodiment of a shank 160 according to the present invention. Shank 160 has a first end 162 and a second end 164 with a first hole 166 in first end 162 and a second hole 168 in second end 164. First hole 166 is dimensioned to receive and accommodate a roller assembly 174 having two wheels 176 joined by an axle 178. First hole 166 has a larger first portion 186 and a smaller second portion 188 in communication with each other. First portion 186 is dimensioned so that a wheel 176 can pass easily therethrough; second portion 188 is dimensioned so that only axle 178 can turn freely therein. Between first and second portions 186 and 188 is a passage 190 that narrows to a width just smaller than segment 180.

From second portion 188 are two cut-out portions 198 that each have a long axis 200 at less than 90 degrees, and preferably approximately 45 degrees with respect to an axis through passage 190 to first portion 186. Cut-out portions 198 provide flexibility for the sides 204 of first hole 166 so that, when roller assembly 174 passes from first portion 186 of first hole 166 to second portion 188 through passage 190, sides 204 can flex outwardly temporarily making such movement easier. However, once in place in second portion 186, movement of roller assembly 174 out of second portion 186 is resisted even more since sides 204 will tend to flex inwardly, further narrowing passage 190. Cut-out portions 198 can allow passage 190 to be made slightly narrower than otherwise to make it both easier to install and harder to remove roller assembly.

At second end 164, second hole 168 also has a larger first portion 210 and a smaller second portion 212. First portion 210 is dimensioned to receive a stop 214 from a button assembly 216. As described before, button assembly 216 has a button 220 and an axle 222 with a reduced portion 224. Stop 214 has a smaller diameter than button 220 but larger than axle 222. Second portion 212 is dimensioned to receive axle 222 so that stop 214 of button assembly 216 can be passed through first portion 210 of second hole 168 but button 220 cannot, and button assembly 216 can be moved from first portion 210 to second portion 212 through a passage 230 therebetween. Passage 230 narrows to a width just smaller than axle 222 to make it more difficult to remove button assembly 216. two cut-out portions 232 near passage 230 provide stress relief when button assembly 216 is moved through passage toward second portion 212 and must push against the sides 234 of passage at its narrowest point.

Figure 7:
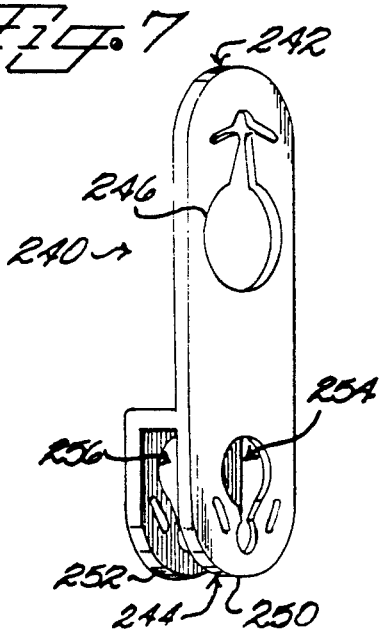
FIG. 7 is a perspective view of an alternative embodiment of a shank according to a preferred embodiment of the present invention.
Figure 8:
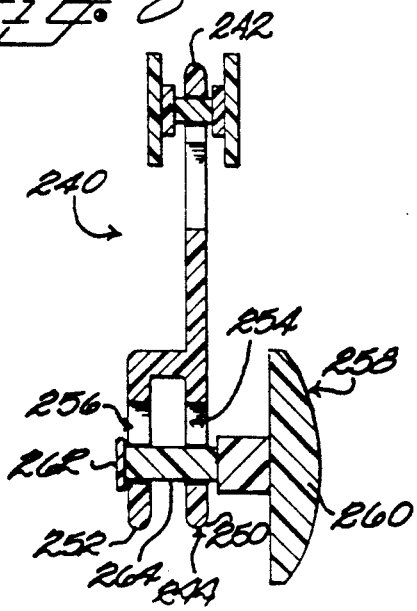
FIG. 8 is a cross sectional view of the shank of FIG. 7.

For heavier flexible closures or greater support of closures, a stronger shank 240 as illustrated in FIGS. 7 and 8 may be used. Shank 240 has a first end 242 and a second end 244. First end 242 has a first hole 246 for a roller assembly 248. Second end 244 is bifurcated or split into a first member 250 and a second member 252. First member has a hole 254 and second member has a hole 256. A button assembly 258, having a button 260, a stop 262, and an axle 264, fits into holes 254 and 256. Holes 254 and 256 also have the keylock feature described above that facilitate installation of button assembly 258 but not easy withdrawal as a result of loosening through use or casual handling.

The carrier assembly shown and described for use with a rail having an internal channel along which the roller assembly can travel freely and securely, contains significant improvements over previous designs in that its holding power is considerably better, the manufacture of the carrier including installation of roller and button assemblies is facilitated, and the stability and resistance to disassembly is improved.

It will be apparent to those skilled in the art that many changes and substitutions can be made to the preferred embodiment herein described without departing from the spirit and scope of the present invention as defined by the appended claims.

What is claimed is:

1. An article for use with a flexible closure support, said article comprising:

a shank having a first end and a second end, said first end having a first hole with a larger portion and a smaller portion, said larger portion and said smaller portion of said first hole lying in a plane, said second end having a second hole with a larger portion and a smaller portion, said larger portion and said smaller portion of said second hole lying in a plane;

a roller assembly carried in said first hole and having a pair of wheels, and an axle joining said wheels, said larger portion of said first hole communicating with said smaller portion of said first hole with first means formed in said first end between said larger portion of said first hole and said smaller portion of said first hole for resisting movement of said roller assembly from said smaller portion of said first hole to said larger portion of said first hole; and a button assembly carried in said second hole and having a button, a stop, and an axle joining said stop and said button, said larger portion of said second hole communicating with said smaller portion of said second hole with second means formed in said second end between said larger portion of said second hole and said smaller portion of said second hole for resisting movement of said button assembly from said smaller portion of said second hole to said larger portion of said second hole.

2. The article as recited in claim 1, wherein said first resisting means further comprises a first passage between said smaller portion and said larger portion of said first hole said first passage being smaller than said smaller portion of said first hole.

3. The article as recited in claim 1, wherein said first resisting means further comprises:

a first passage between said smaller portion and said larger portion of said first hole, said first passage being smaller than said smaller portion of said first hole; and means in communication with said first end for making said passage narrower when said roller assembly is moved toward said passage.

4. The article as recited in claim 1, wherein said first resisting means further comprises:

a first passage between said smaller portion and said larger portion, of said first hole said first passage being smaller than said smaller portion of said first hole; and at least one cut-out portion communicating with said smaller portion of said first hole and oriented with respect to said roller assembly so that said first end flexes to make said passage narrower when said roller assembly is moved from said smaller portion of said first hole.

5. An article for use with a flexible closure support, said article comprising:

a shank having a first end and a second end, said first end having a first hole with a larger portion and a smaller portion, said larger portion and said smaller portion of said first hole having a first passage therebetween, said first passage being smaller than said smaller portion, said shank having first means for enlarging said first passage temporarily, said second end having a second hole with a larger portion and a smaller portion, said larger portion and said smaller portion of said second hole having a second passage therebetween, said second passage being smaller than said smaller portion smaller said shank having second means for enlarging said second passage temporarily;

a roller assembly carried in said first hole and having a pair of wheels, and an axle joining said wheels, said axle dimensioned to pass through said first passage when said first passage is expanded; and a button assembly carried in said second hole and having a button, a stop, and an axle joining said stop and said button.

6. The article as recited in claim 5, wherein said first hole has sides and said first enlarging means further comprises at least one cutout portion in space relation to said first passage of said first hole to weaken said sides of said first hole near said first passage so that said sides can flex outwardly and thereby enlarge said first passage.

7. The article as recited in claim 5, wherein said first hole has sides and said first enlarging means further comprises at least one cutout portion in spaced relation to said first passage and communicating with said smaller portion of said first hole to weaken said sides of said first hole near said first passage so that said sides can flex outwardly and thereby enlarger said first passage.

8. The article as recited in claim 5, wherein said first hole has sides and said first enlarging means further comprises two cutout portions in spaced relation to said first passage and communicating with said smaller portion of said first hole to weaken said sides of said first hole near said first passage so that said sides can flex outwardly and thereby enlarge said first passage.

9. The article as recited in claim 5, wherein said first hole has sides and said first enlarging means further comprises at least one cutout portion in spaced relation to said first passage and communicating with said smaller portion of said first hole to weaken said sides of said first hole near said first passage so that said sides can flex outwardly and thereby enlarge said first passage when said roller assembly passes from said larger portion to said smaller portion through said first passage but flex inwardly to narrow said first passage when said roller assembly is moved from said smaller portion toward said passage.

10. The article as recited in claim 5, wherein said first hole has sides and said first enlarging means further comprises at least one cutout portion communicating with said smaller portion of said first hole and deployed at an angle of less than 90 degrees with respect to said first passage so that said sides can flex outwardly and thereby enlarge said first passage when said roller assembly passes from said larger portion to said smaller portion through said first passage.

11. The article as recited in claim 5, wherein said first hole has sides and said first enlarging means further comprises at least one cutout portion communicating with said smaller portion of said first hole and deployed at an angle of less than 90 degrees with respect to said first passage so that said sides can flex outwardly and thereby enlarge said first passage when said roller assembly passes from said larger portion to said smaller portion through said first passage but flex inwardly to narrow said first passage when said roller assembly is moved from said smaller portion toward said passage.

12. The article as recited in claim 5, wherein said second hole has sides and said second enlarging means further comprises at least one cutout portion in spaced relation to said second passage of said second hole to weaken said sides of said second hole near said second passage so that said sides can flex outwardly and thereby enlarge said second passage.

13. The article as recited in claim 5, wherein said second hole has sides and said second enlarging means further comprises at least one cutout portion in spaced relation to said second passage and communicating with said smaller portion of said second hole to weaken said sides of said second hole near said second passage so that said sides can flex outwardly and thereby enlarge said second passage.

14. The article as recited in claim 5, wherein said second hole has sides and said second enlarging means further comprises two cutout portion in spaced relation to said second passage and communicating with said smaller portion of said second hole to weaken said sides of said second hole near said second passage so that said sides can flex outwardly and thereby enlarge said first passage.

* * * * *